US006817045B1

(12) United States Patent
Fainberg

(10) Patent No.: US 6,817,045 B1
(45) Date of Patent: Nov. 16, 2004

(54) APPARATUS FOR SAFELY, COMFORTABLY, AND COMPLETELY BATHING ONESELF

(76) Inventor: Abram Fainberg, 7 Roger Williams Green, Providence, RI (US) 02904

( * ) Notice: Subject to any disclaimer, the term of this patent is extended or adjusted under 35 U.S.C. 154(b) by 0 days.

(21) Appl. No.: 10/642,537

(22) Filed: Aug. 18, 2003

(51) Int. Cl.[7] ..... A47K 3/022; A47K 3/28

(52) U.S. Cl. ..... 4/605; 4/560.1; 4/564.1; 4/565.1; 4/606

(58) Field of Search ..... 4/559, 560.1–566.1, 4/579, 601, 604–606; 601/97, 98

(56) References Cited

U.S. PATENT DOCUMENTS

| | | | | | |
|---|---|---|---|---|---|
| 3,040,335 A | | 6/1962 | Gellman | 4/185 |
| 3,802,421 A | * | 4/1974 | Williams | 4/559 |
| 4,150,445 A | | 4/1979 | Bailey | 4/185 LR |
| 4,356,583 A | * | 11/1982 | Wallasch et al. | 601/97 |
| 4,574,408 A | | 3/1986 | Dentler et al. | 4/560 |
| 5,121,511 A | | 6/1992 | Sakamoto et al. | 4/601 |
| 5,129,112 A | | 7/1992 | Schaffer | 4/560.1 |
| 5,335,378 A | * | 8/1994 | Chiang | 4/606 |
| 5,855,028 A | | 1/1999 | Colbert | 4/566.1 |
| 6,213,964 B1 | | 4/2001 | Pesovic et al. | 4/566.1 |
| 6,415,459 B1 | | 7/2002 | Sevier | 4/566.1 |

* cited by examiner

*Primary Examiner*—Tuan Nguyen

(57) ABSTRACT

An apparatus for safely, comfortably, and completely bathing oneself without aid of another person and method to operate the same are disclosed. The apparatus includes a frame with two vertical posts on which slides a carriage with means of a reciprocating belt and showering means for soaping and showering bathers back, a chair for bathing in sitting position, a water supply system, a hand shower, a coil of hoses with numerous spout holes, mounted under said chair, for washing bottom parts of said body, and an appliance for washing and massaging the feet.

17 Claims, 3 Drawing Sheets

APPARATUS FOR SAFELY, COMFORTABLY, AND COMPLETELY BATHING ONESELF

FIELD OF THE INVENTION

The present invention relates to bathing devices and, more particularly, pertains to assisting the bather obtain a comfortable, safe, and complete bath without the aid of another person.

DESCRIPTION OF THE PRIOR ART

A variety of bathtub inserts are known in the art. A number of these devices in different fulfillment intend that persons safely get into and out of a conventional tub. For instance, U.S. Pat. No. 4,574,408 to Dentler discloses a bathtub platform lift device, U.S. Pat. No. 5,855,028 to Colbert discloses an inflatable system for bath lift device, U.S. Pat. No. 5, 129,112 to Shafer discloses a chair lift device. While all of these devices fulfill their respective, particular objective and requirements, the aforementioned patents do not disclose an apparatus permitting a person to bathe himself/herself not only safely but also completely (including back, bottom, and feet) without an assistant.

U.S. Pat. No. 3,040,335 to Gellmann and U.S. Pat. No. 4,150,445 to Bailey shown a shower chain assembly whereby the sprays, directed from under the seat, can cleanse the ano genital areas of the body. However, the users of both of these devices can't completely bathe oneself without assisting with another person. Furthermore these suggested devices are two complicated and unacceptable for the present purposes due both to the relatively high initial cost, and also to the loss or restriction of the facility for normal use when anyone wishes a regular shower or bath.

SUMMARY OF THE INVENTION

It is an essential objective of the present invention to provide an apparatus for bathing in safety and comfort for a broad category of users, including elderly and disabled persons.

It is another objective of the present invention to provide a bathing apparatus that the user can operate safely in sitting position without the aid of another person.

It is still another objective of the invention to provide a bathing apparatus, which does not require any special modification to a conventional tub structure.

It is a further objective of the present invention to provide a bathing apparatus with elements for bathing all parts of one's body including back, seat, and feet.

It is yet another objective of the present invention to provide a bathing apparatus that does not require that it be moved out in cases when anyone would want a regular shower or bath.

A further objective of the present invention is to provide a bathing apparatus, which will conform to conventional forms of manufacture, be of simple construction, easy to use, economically feasible, long lasting, and relatively trouble free in operation.

These together with other objectives of the invention, along with the various features of novelty, which characterize the invention, are pointed out with particularity in the claims annexed to and forming a part of this disclosure. For a better understanding of the invention, its operating advantages and the specific benefits attained by its uses, refer to the accompanying drawings and descriptive matter in which there are illustrated preferred embodiments of the invention.

DESCRIPTION OF THE PREFERRED EMBODIMENT

Figure 1:
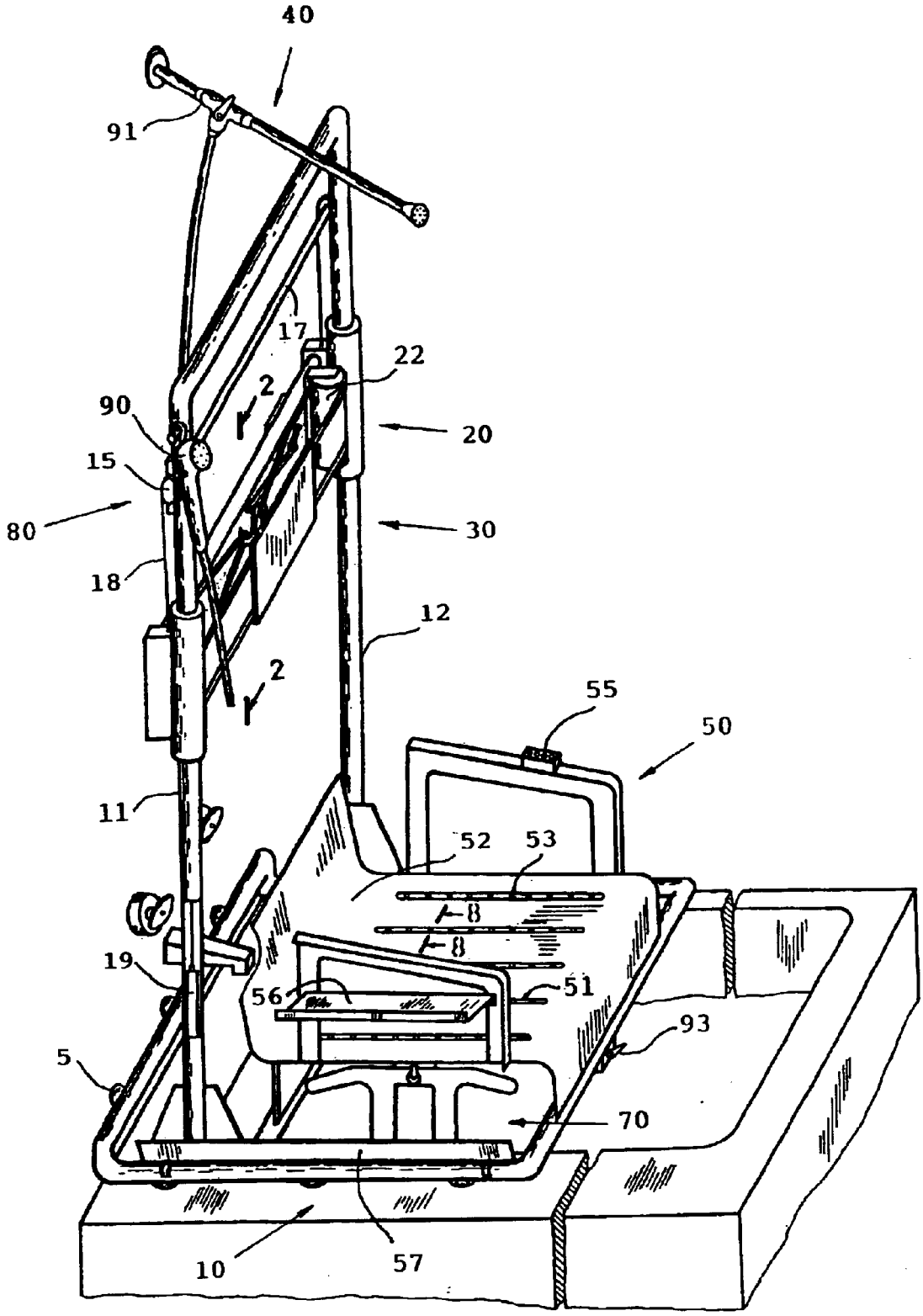
FIG. 1 is a perspective view of the preferred bathing apparatus made in accordance with the present invention.

The present invention is an apparatus for completely bathing by the user himself/herself all his/her body including back, seat, and feet. The apparatus (see FIG. 1) includes a frame 10 with posts 11 and 12 on which slide a carriage 20 with means of reciprocating belt 30 and showering means 99 (FIG. 7) for soaping and showering bathers back, a water supply system 40, a chair 60, and an appliance 70 for bathing and massaging the bathers feet The movement of the carriage 20 up and down (FIGS. 1 and 2) is provided by drive means 80 having two sheaves 15 rigidly attached on a rotating axle 17, a gear-motor 81 which operates the axle 17. The carriage 20 by ropes 18, to be thrown on grooves of the sheaves 15, is connected with counterweights 19 to provide easy movement of the carriage. The means of reciprocating belt 30, as shown in FIG. 3, consists of a permanently installed belt 110 and a removable piece of bast 120. The belt 110 includes a synthetic strap 41, a rope which forms a loop 43 adjustable cord which forms a second loop 45, and a grip 35. Connecting the rope and the cord to the synthetic strap 41 are provided by stitching or gluing.

Figure 2:
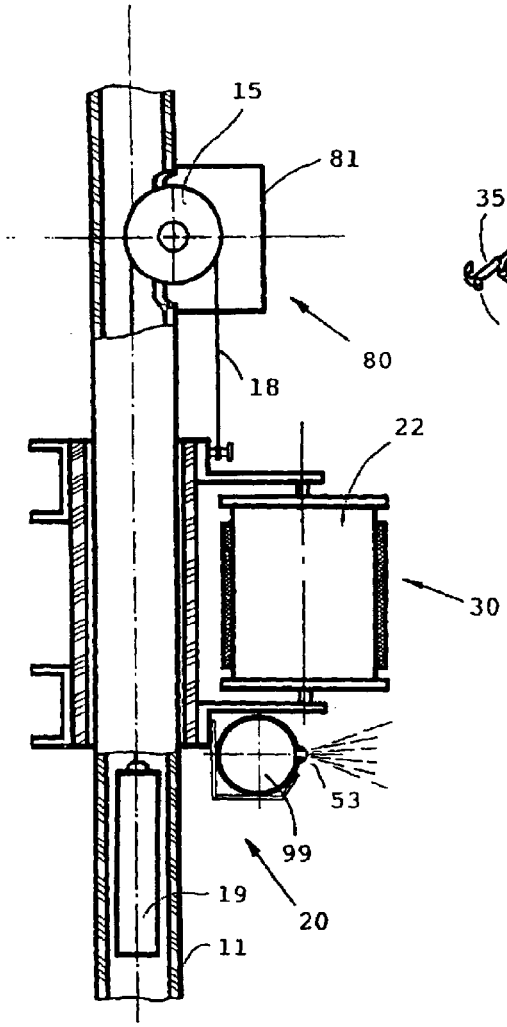
FIG. 2 is a sectional view taken along line 2—2 of FIG. 1 with portions broken away illustrating the primary structure of the carriage and its drive mechanism for moving up and down.
Figure 3:
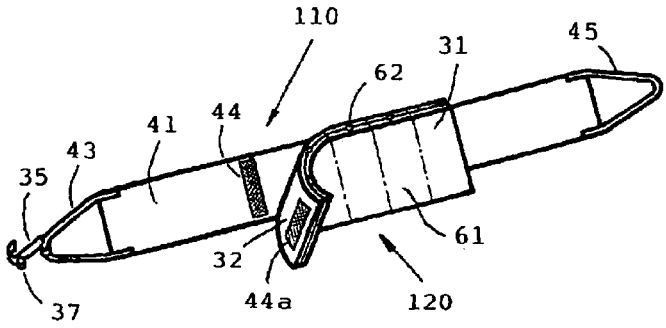
FIG. 3 is a perspective view of the reciprocation belt.
Figure 4:
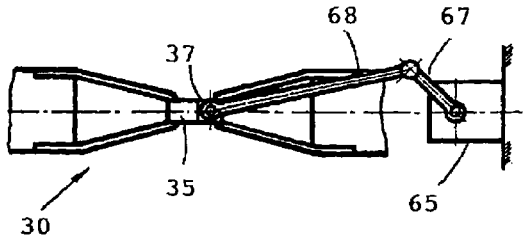
FIG. 4 is a schematic view of the drive mechanism for providing the belt in reciprocating movement.

As it can see in FIGS. 1 and 2 the means of reciprocating belt 30 is situated on the rolls 22 of the carriage and joined by grip 35 (FIG. 4). The loop 45, which is made from adjustable cord, holds the belt 30 in tension position. The grip 35 has a hook 37 (FIG. 3) for effecting a reciprocating motion to the belt 30. The removable piece of bast 120 has two straps 31 and 32. The strap 31 is made of a special bathing material, from natural fiber loofah, which is excellent for cleansing the skin. The other strap 32 is made from regular soft cloth. Both straps 31 and 32 are stitched together so that between them is formed one or more pockets 61, in which through holes 62 can be pumped soap. In the process of bathing by pressure from the users back this pumped soap goes out through small holes in the strap 31 (not shown) to form lather. Attaching the piece of bast 120 to belt 110 is provided by quick fastener strips 44 and 44*a* (market "sticky back" of the Velcro Co.) or the like.

Reciprocation of the belt 30 as it seen in FIG. 4, is provided by gear-motor 65, which is installed in water resistant case and mounted on the carriage 20. Crank 67 and connection rod 68 transfer the motion from the gear-motor 65 to the belt 30.

The means 99 (FIGS. 2 and 7) for showering the users back includes a hose with numerous holes 53 or one or more showerheads attached to carriage 20 and operated by valve 98. After covering the back with soap the user can washing it by open valve 98 and moving the carriage 20 up and down.

Figure 5:
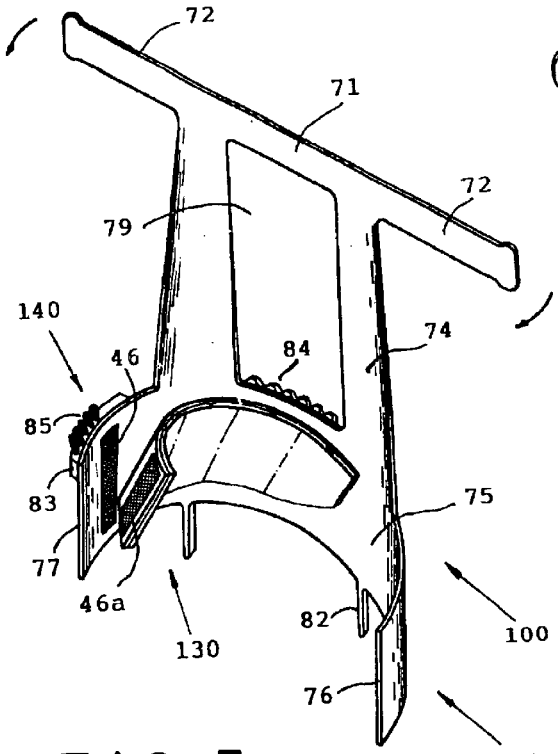
FIG. 5 is a perspective view of the appliance for bathing and massaging the feet.
Figure 6:
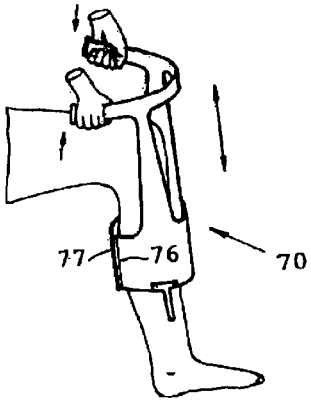
FIG. 6 is a perspective view of the appliance for bathing and massaging the feet in the process of bathing.

Washing of the feet (from knee and lower) is a problem not only for elderly people but also for everybody especially for washing between toes and nearer to foot. This problem will be solved by using an appliance 70 (FIGS. 5 and 6). The appliance comprises a base 100 preferably molded from plastic in a one-piece construction, removable piece of bast 130 and a set of massaging attachments 140. The upper portion of the base 100 is a straight strip 71 with two handles 72. In the middle part of the strip 71 the thickness is smaller for easy bending.

By two legs 74, which apart about 5", the strip 71 is connected with lower portion 75 to form an opening 79 for massaging the feet at edges of the opening. The lower portion 75 has the form of a broken cylinder. But when the bather bends the upper portion 71 of the base 100 the edges 76 and 77 of the lower portion 75 are closed up to form approximately a circumferential construction. To the inside surface of the portion 75 by quick fastener strips 46 and 46*a* is attached the piece of bast 130, which preferably has the same construction and size as the piece of bast 120. The portion 75 has also numerous holes (not shown) for fastening the set of massaging attachments 140. These attachments comprise two pins 82 for cleaning between toes of the feet and several interchangeable strips 83 having numerous mechanical massaging protrusions such as knobs 84, and brushes 85. The strip 83 with knobs 84 and the pins 82 are preferably molded from suitable materials, such as known elastomeric and other rubber-like materials, which has some elastic capability. Said materials provide desirable massage textures, soft or hard, coarse or fine.

Figure 7:
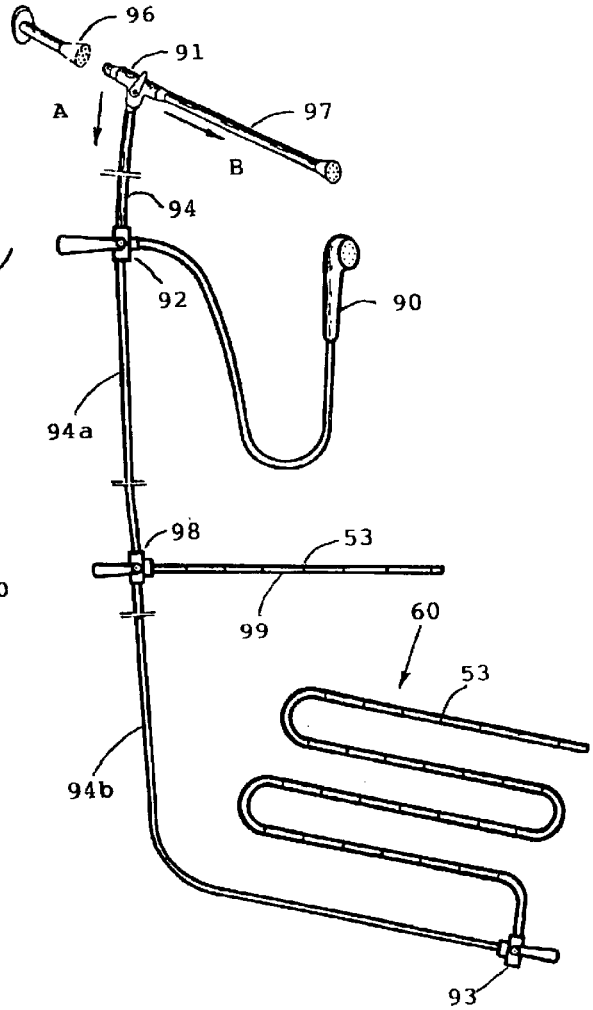
FIG. 7 is a schematic view of the water supply system.

The water supply system 40, as shown in FIG.7, comprises a valve 91 for directing water for bathing (arrow "A"), or taking only shower (arrow "B"), a valve 92 for supplying water to hand shower 90, a valve 98 for supplying water to means 99, a valve 93 for providing spray by coil 60 through seat of the chair 50, and three pieces of hose 94, 94*a* and 94*b* of suitable length for connection with the values. The installation of the water supply system 40 in a common bathroom includes unscrewing domestic showerhead 96 (shown by dotted lines) and connecting it to the end of the pipe 97 of the system 40.

Figure 8:
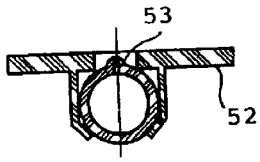
FIG. 8 is a cross-sectional view of the chair-sprinkler taken along line 8—8 of FIG. 1.

The chair 50 (FIG. 1) with a few slots 51 in the seat 52 is mounted to the frame 10 of the apparatus. Under seat 52 is attached a coil 60 (FIG. 7), which has same spout holes 53 (FIG. 8) as the means 99, placed along the slots 51 of the chair to provide a shower one's seat.

The apparatus of the present invention (FIG. 1) is equipped with numerous rubber suction cups 5. These cups fasten to the walls of the bathroom and to the horizontal upper surfaces of the tub, to stabilize the apparatus on the tub and avoid any structural modification. The apparatus is equipped also with a small removable shelf 56 for holding bathing accessories and with plastic baffle 57, to avoid splashing water on the floor. Both the shelf and the plastic baffle can be molded in a one-piece construction and fastened to the frame 10.

For bathing oneself by using apparatus according to the present invention, the user adjusts the consumption and temperature of the water, directing it by valve 91 on arrow "A" (FIG.7), and filling soap into the pockets 61 of the pieces of bast 120 and 130. Then he sits on the chair 50 and washes all accessible parts of the body by using soap, piece of bast, and hand shower 90. Using the means of reciprocating belt 30, which covers the bathers back with soap, and showering means 99, provides bathing the back. The next step in the process of bathing oneself in the seating position is washing one's bottom. For doing it the user covers his bottom with soap, which is accessible, and showers using the coil 60 by turning the valve 93. The last operation in the process of bathing oneself is washing the feet, which is facilitated by the appliance 70. As it can be seen in FIGS. 5 and 6 the bather squeezes the lower portion 75 around each foot and moves the appliance 70 up and down to cover the feet with soap. After that he uses the shower. Two pins 82 of the appliance 70, which have different textures, provide cleaning the places between toes of the feet. Also, for massaging the back and the feet the bather can use the means of reciprocating belt 30 and the massaging attachments 140.

The space occupied by the apparatus of the present invention is small and allows taking a shower or bath without removing the apparatus from the tub.

Although particular embodiments of the present invention have been illustrated and described, it will be apparent to those skilled in the art that various changes and modifications can be made without departing from the spirit of the present invention, and it is intended to cover in the appended claims all such changes and modifications that fall within the scope of the present invention.

I claim:

1. An apparatus for safely, comfortably, and completely bathing by the user itself comprising:

a. a frame for holding the components of the apparatus and stabilizing it on the tub without any structure modification of said tub;

b. a carriage for sliding up and down along the vertical posts of said frame, said carriage comprising a means of reciprocation belt and means of showering for soaping and showering bathers back;

c. a drive means for moving said carriage up and down and for operating said means of reciprocated belt;

d. a chair, mounted to said frame, for bathing in sitting position;

e. a water supply system, and f. a hand shower.

2. The apparatus of claim 1, wherein said water supply system comprises:

a. a hand shower;

b. a means for showering the users back;

c. a coil means for showering the users bottom, and d. some valves and hoses of corresponding length.

3. The apparatus of claim 1, wherein said means of reciprocation belt, which is situated on two rollers of said carriage, comprising:

a. a belt (110) made from plastic or other suitable material with loop (43) on one end and loop (45) on other end, said at least one loop is made from adjustable cord or strip;

b. a grip for joining said loops (43) and (45) to form said belt (110) as endless, which is situated on rolls, said adjustable cord or strip holds said belt (110) in tension position;

c. a piece of bast (120), which includes an outer strap, made from a special bathing material, for instance, from natural fiber loofah, an inner strap, made from some soft cloth, said outer and inner straps are joined together generally by stitching, and several quick fastener strips which are stitched to said inner strap and to said belt (110) for attaching said piece of bast (120) to said belt (110).

4. The apparatus of claim 3, wherein said piece of bast (120) and some parts of said belt (110) are stitched together to form a whole belt.

5. The apparatus of claim 3, wherein said outer and inner straps are stitched so that between them is formed one or more pockets with holes for pumping soap inside.

6. The apparatus of claim 1, wherein the drive means for moving said carriage up and down comprises:

a. a gear motor mounted to said frame;

b. an axle to be driven by said gear motor, said axle having two sheaves rigidly attached on the ends of said axle;

c. two ropes, which are thrown on said sheaves and are connected to said carriage and to counterweights, to make easy movement up and down of said carriage.

7. The apparatus of claim 1, wherein said drive means for operation of said means of reciprocation belt comprises:

a. a gear motor (65), mounted on said carriage;

b. a crank, and c. a connecting rod, which is connected to said crank and to the hook of said grip.

8. The apparatus of claim 1, wherein the drive means for moving said carriage up and down and for operating said reciprocating belt, is accomplished by hand operated mechanisms.

9. The apparatus of claim 1, further includes an appliance for washing and massaging the feet, said appliance comprises:

a. a base preferably molded from plastic in a one-piece construction, said base having an upper portion with two handles, two legs, which are apart about 5 inches, and a lower portion with numerous holes, said upper portion, lower portion and two legs form an opening for massaging the feet at edges of said opening, said lower portion farther has form of a broken cylinder, which turns by bending said upper portion in circumferential construction;

b. a removable piece of bast (130), which preferably has same size and construction as said piece of bast (120) of said means of reciprocating belt, said piece of bast (130) attached to inside surface of said lower portion by said quick fastener strips.

c. a set of massaging attachments, which includes at least one pin for cleaning between toes of the feet and several interchangeable strips (83) with mechanical massaging protrusions such as knobs and brushes.

10. The apparatus of claim 1, wherein it does not require any special modification to a conventional tub structure.

11. The apparatus of claim 1, wherein it does not require to be moved out when anyone wishes a regular shower or bath.

12. The apparatus of claim 1, wherein said rolls have lugs or grooves for preventing said means of reciprocating belt to move out of said rolls.

13. The apparatus of claim 1, wherein the stabilizing of it on said tub is provided by numerous rubber suction cups, which are fastened to vertical walls of the bathroom and to upper surfaces of said tub.

14. The apparatus of claim 1 comprising a removable shelf for holding bathing accessories.

15. The apparatus of claim 1 father comprising a plastic baffle to avoid splashing water on the floor.

16. Method for completely bathing oneself in safety and in a comfortable position by using apparatus according to claim 1, comprising at least the steps of:

a. adjusting the consumption and temperature of the water and directing it by valve on arrow (A), b. filling liquid soap into said pockets of said pieces of bast (120) and (130), c. sitting on chair and washing all accessible parts of the body by using soap, piece of bast, and hand shower;

d. bathing the back by using said means of reciprocating belt and means of back showering;

e. bathing the one's bottom by using soap, piece of bast, and shower from the coil, winch is operated through chair.

17. Method according to claim 16, further comprising step of washing and massaging the feet by using said appliance and said hand shower.

* * * * *